US005088932A

United States Patent [19]

Nakamura

[11] Patent Number: 5,088,932

[45] Date of Patent: Feb. 18, 1992

[54] ELECTRICAL CONNECTOR

[75] Inventor: Masahiko Nakamura, Kitakatsuragigun, Japan

[73] Assignee: Hosiden Corporation, Yao, Japan

[21] Appl. No.: 619,413

[22] Filed: Nov. 29, 1990

[30] Foreign Application Priority Data

Dec. 4, 1989 [JP] Japan ..... 1-141020[U]

[51] Int. Cl.[5] ..... H01R 13/627

[52] U.S. Cl. ..... 439/350; 439/610

[58] Field of Search ..... 434/607, 609, 610, 350, 434/353, 357, 358

[56] References Cited

U.S. PATENT DOCUMENTS

| | | | |
|---|---|---|---|
| 4,678,256 | 7/1987 | Nishino et al. | 439/607 |
| 4,699,438 | 10/1987 | Kikuta | 439/607 |
| 4,726,783 | 2/1988 | Nakazawa et al. | 439/350 |
| 4,936,793 | 6/1990 | Uchida | 439/350 |
| 4,961,711 | 10/1990 | Fujiura et al. | 439/610 |

*Primary Examiner*—Larry I. Schwartz
*Assistant Examiner*—Hien D. Vu
*Attorney, Agent, or Firm*—Jones, Tullar & Cooper

[57] ABSTRACT

According to the electrical connector of the present invention, locking levers are disposed with the use of the spaces inevitably formed between the connector body and a shield frame unit which surrounds the connector body, and engagement pieces formed at the locking levers are adapted to be engaged with and disengaged from engagement portions formed at a counter electrical connector to be connected to the electrical connector.

The shield frame unit shuts off electrical noise and it is possible, without the electrical connector being increased in size, to prevent the counter electrical connector from being unexpectedly pulled out. The engagement pieces may be made of metal and the engagement portions may be made of synthetic resin. In this case, even though the counter electical connector is forcibly pulled out, this merely damages the engagement portions without adverse effects exerted upon the signal transmission/reception function and the like of the electrical connector.

5 Claims, 5 Drawing Sheets

FIG. 4
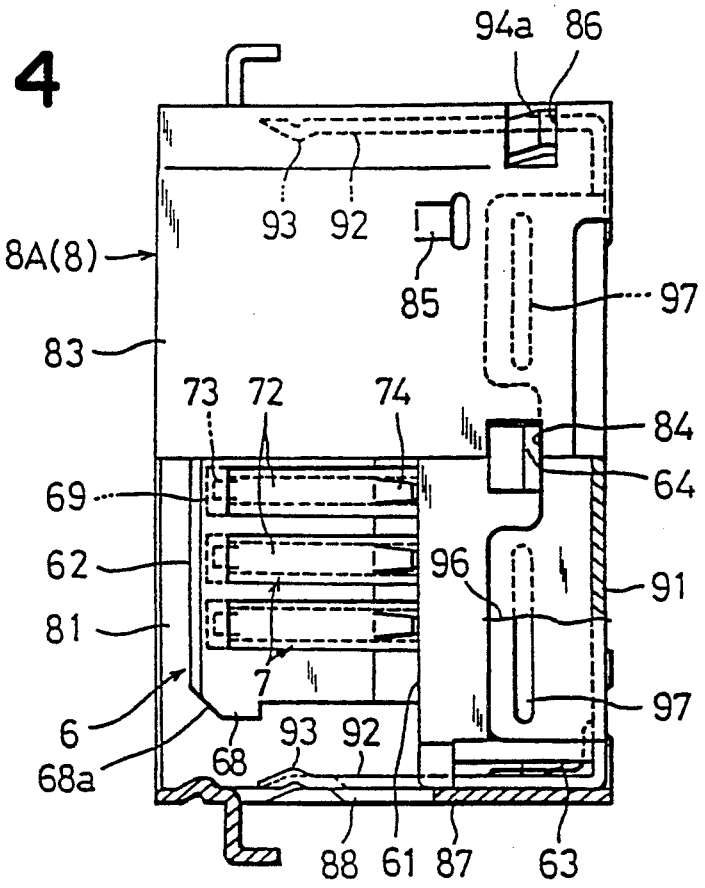
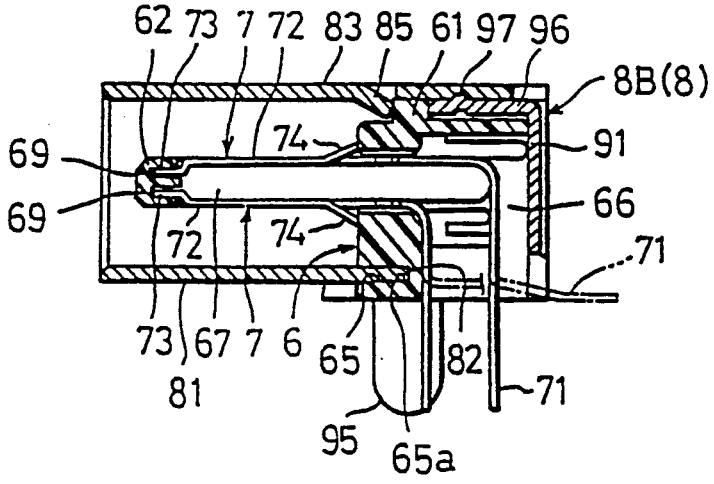
FIG. 5

ELECTRICAL CONNECTOR

BACKGROUND OF THE INVENTION

1. Field of the Invention

The present invention relates to an electrical connector having a shield frame to shut off an electrical noise, and more particularly to an electrical connector to be used as a plug (hereinafter referred to as plug).

2. Discussion of The Related Art

As a plug so arranged as to shut off an electrical noise, there is known a plug having a shield frame made of metal. An electrical connector to be used as a socket (hereinafter referred to as socket) is selected as the counter member of the plug of the type above-mentioned. The socket has also a shield frame surrounding the peripheries of the contact pieces. When the plug is inserted into the socket, the shield frames of both the plug and the socket are electrically connected to each other to produce a shielding effect.

The plug and the socket may be connected to each other, for example, by inserting the plug into the socket mounted on a printed circuit board so that the socket contact pieces are contracted, under a predetermined contact pressure, with the plug contact pieces. The contact forces resulting from the pressure of the contact pieces generated at that time are so utilized as to prevent the plug from coming out from the socket.

However, the contact forces resulting from the pressure of the contact pieces mentioned above are not so great. Accordingly, if a signal cable connected to the plug is forcibly pulled on to apply a great pulling force to the plug, the plug is forcibly pulled out from the socket. This may result in an unexpected disconnection between the plug and the socket.

To prevent such an unexpected accident, it may be effective to dispose a locking mechanism which is adapted to automatically lock the plug and the socket when the plug is inserted into the socket, and which is adapted such that the locked state is not released unless a predetermined lock-releasing operation is carried out. As such electrical connectors, there are known a plug and a socket each provided on the outer surface thereof with a metallic locking mechanism, these locking mechanisms being adapted to be engaged with and disengaged from each other.

However, since these locking mechanisms are disposed on the outer surfaces of the plug and the socket, the locking mechanisms outwardly project from the plug and the socket. This presents the problem that the connectors are considerably increased in size and appear to be damaged.

Further, the engagement members and the members to be engaged of the locking mechanisms are made of metal. Accordingly, when a great force is applied to these engaged portions of the locking mechanisms in the locked state, the engagement members and the members to be engaged may be bent, deformed or bit by each other, causing the locking mechanisms not to be used any more.

SUMMARY OF THE INVENTION

The present invention is proposed in view of the problems mentioned above.

It is an object of the present invention to provide a plug or electrical connector adapted such that, when the plug is connected to a socket, the connected portions are shut off from electrical noise.

It is another object of the present invention to provide a plug or electrical connector having a socket locking function.

It is a further object of the present invention to provide a plug or electrical connector of which sizes are restrained from being increased even though the plug has a locking function.

It is still another object of the present invention to provide a plug or electrical connector of which a locking function is automatically effected when the plug is inserted into a socket.

It is a still further object of the present invention to provide a plug or electrical connector adapted such that, when the plug as inserted into a socket is forcibly pulled out therefrom, the locking function of the plug does not work, but the plug and the socket can be continuously used thereafter.

It is yet another object of the present invention to provide a plug or electrical connector adapted such that, when the plug inserted into a socket is intentionally pulled out therefrom, the locking mechanism of the plug can be released without any special attention paid thereto.

It is a yet further object of the present invention to provide a plug or electrical connector of which the entire strength thereof is enhanced with the use of a shield frame.

To achieve the objects mentioned above, the electrical connector in accordance with an embodiment of the present invention comprises:

a main body which houses and holds a plurality of contact pieces in parallel with one another;

a shield frame unit surrounding the rear portion of the main body;

locking levers housed in the inside spaces at the lateral sides of the shield frame unit in the parallel arranging direction of the contact pieces;

projections formed at the shield frame unit for rotatably supporting the locking levers;

engagement pieces formed at the front ends of the locking levers and adapted to be engaged with and disengaged from engagement portions of a counter electrical connector when the locking levers are displaced as forwardly and reversely rotated around the projections;

biasing means disposed between the locking levers and the shield frame unit and adapted to resiliently bias the locking levers in the forward rotation direction that the engagement pieces of the locking levers are engaged with the engagement portions mentioned above; and operating portions disposed at the locking levers and adapted to displace the locking levers in the reverse rotation direction that the engagement pieces of the locking levers are separated from the engagement portions against the resilient biasing forces of the biasing means.

According to the electrical connector having the arrangement mentioned above, those portions of the electrical connector which are connected to the counter electrical connector, are shut off from electrical noise. Further, the electrical connector may be provided with a locking function for locking the counter electrical connector without requiring that the electrical connector be increased in size. Further, this locking function may be automatically achieved when the electrical connector of the present invention is inserted into the counter electrical connector.

According to the present invention, the engagement portions of the counter electrical connector may be made of synthetic resin, and the engagement pieces of the locking levers may be made of metal.

With such an arrangement, even though this electrical connector inserted into a counter electrical connector is forcibly pulled out therefrom, the engagement portions of synthetic resin which is apt to be sheared more easily than metal are merely sheared, and the metallic engagement pieces are not damaged. Accordingly, the locking function does not work any more, but such shearing does not damage the original function of the electrical connectors, i.e., the signal transmission/-reception function. As a result, the electrical connectors may also be continuously used thereafter.

According to the present invention, the biasing means for resiliently biasing the locking levers in the forward rotation direction may comprise: spring plate portions formed, at the other ends of the locking levers, as bent in an U-shape; and plate portions formed at the shield frame unit and facing the tip portions of the spring plate portions.

According to the electrical connector mentioned above, the locking levers or the shield frame unit may be provided with the biasing means mentioned above. This reduces the number of component elements, thus simplifying the assembling of the electrical connector.

According to the present invention, the shield frame unit may be divided into an upper frame and a lower frame, the upper and lower frames being provided at the end edges of left- and right-hand leg portions thereof with inwardly turned engagement pieces, and the main body may be provided on both lateral sides thereof with longitudinally extending engagement grooves, into which the engagement pieces of the upper and lower frames as overlapping each other are inserted.

According to the electrical connector mentioned above, the leg portions of the frame unit are useful in improving the rigidity of the electrical connector. The rigidity thus improved by the leg portions may be further improved by the arrangement that the engagement pieces of the upper frame overlap the engagement pieces of the lower frame. Thus, the electrical connector is greatly increased in strength in its entirety.

According to the present invention, the operating portions may be located in the positions at which the electrical connector is adapted to be grasped when pulling out the electrical connector.

With this arrangement, in pulling out the electrical connector mentioned above from the counter electrical connector, the operating portions are pushed in to automatically release the locked state, when the operator grasps the electrical connector.

Various other features and operational effects of the present invention will be apparent from the following description with reference to the attached drawings showing embodiments of the present invention.

BRIEF DESCRIPTION OF THE DRAWINGS

FIG. 4 is a plan view, with portions broken away, of a counter electrical connector to be connected to the electrical connector of the present invention;

FIG. 5 is a vertical section view of the counter electrical connector; and

DETAILED DESCRIPTION OF THE PREFERRED EMBODIMENTS

Figure 1:
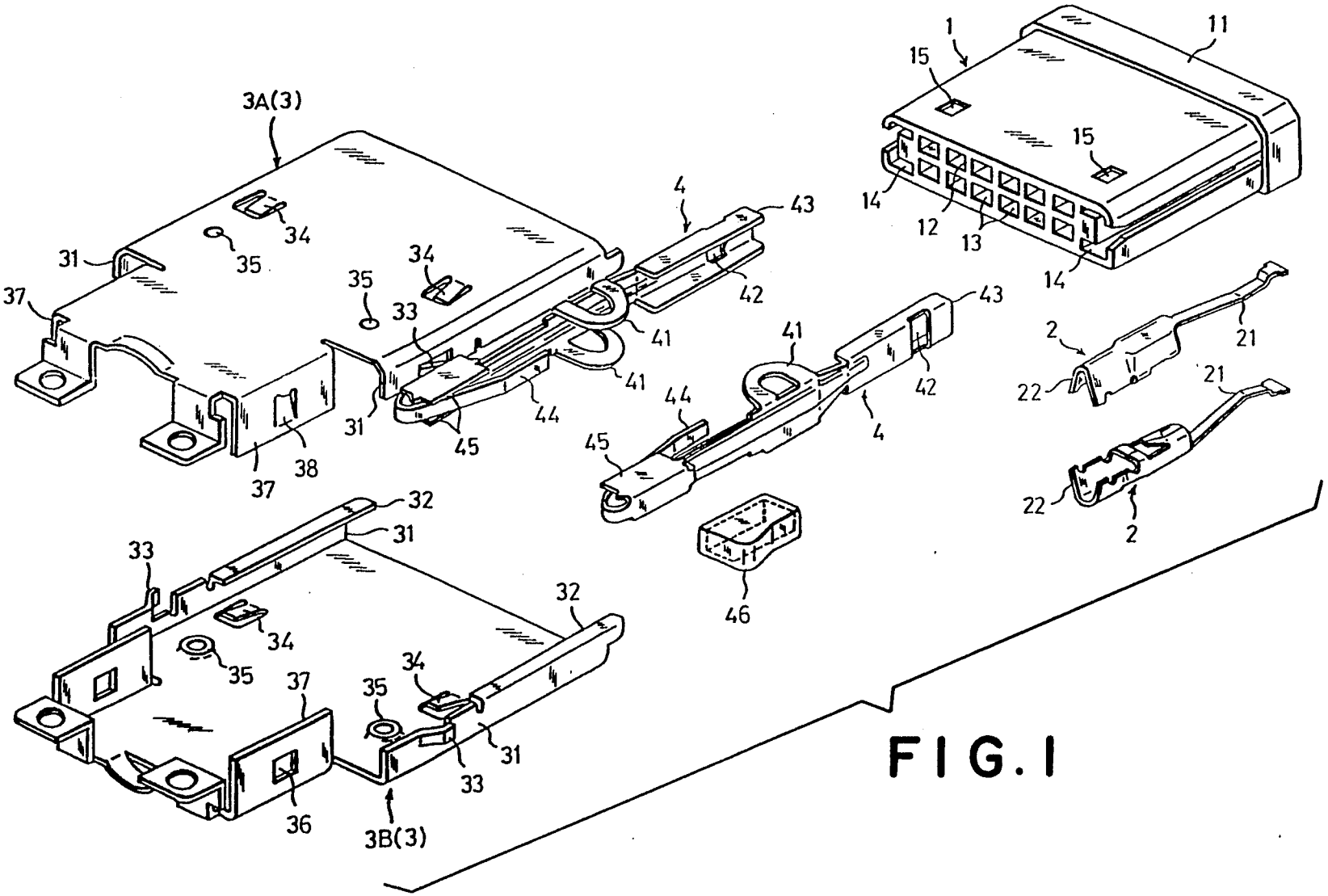
FIG. 1 is an exploded perspective view of an electrical connector in accordance with the present invention.

FIG. 1 shows an electrical connector or a plug P having a main body 1 having insulating properties, metallic contact pieces 2, a metallic shield frame unit 3 and metallic locking levers 4.

The main body 1 is provided at the front end thereof with a flange 11 and inside thereof with a plurality of contact pieces insertion holes 13 formed as partitioned by ribs 12 in the form of a lattice. The main body 1 is provided in the lateral sides thereof with longitudinally extending engagement grooves 14. The main body 1 is also provided in the upper or lower surface thereof with engagement holes 15.

The contact pieces 2 are metallic pieces. Each of the contact 2 is provided at the tip thereof with a contact 21 and at the rear end thereof with a forked holding piece 22. When assembling the contact pieces 2 with the main body 1, a plurality of contact pieces 2 are connected to one another with a tie bar. This tie bar will be cut at the time when the forked holding pieces 22 of the contact pieces 2 are calked with electric wires to be discussed later. The contact pieces 2 are respectively inserted into the contact piece insertion grooves 13 in the main body 1 and assembled with the main body 1 such that the contact pieces 2 are parallel with one another and do not come out therefrom.

The shield frame unit 3 is divided into an upper frame 3A and a lower frame 3B. The lower frame 3B has a U-shaped section and is provided at both lateral sides thereof with leg portions 31. The leg portions 31 are provided at the edges of the front ends thereof with inwardly turned engagement pieces 32 and at the rear ends thereof with outwardly turned engagement pawls 33 as cut and raised. The lower frame 3B is provided on the bottom plate thereof with engagement pawls 34 and projections 35. The upper frame 3A has an arrangement substantially identical with that of the lower frame 3B. The upper frame 3A is different from the lower frame 3B in that the upper frame 3A has engagement pawls 38 corresponding to engagement holes 36 formed in the lower frame 3B. Thus, like parts of the upper frame 3A are designated by like reference numerals used in the lower frame 3B, and the detailed description thereof is here omitted.

Each of the locking levers 4 is provided at the longitudinal center portion thereof with a pair of upper and lower ring portions 41. Each of the locking levers 4 is provided at one end thereof with a U-shaped engagement piece 43 having a locking hole 42. Each locking lever 4 is also provided at the other end thereof with a spring plate portion 44 turned into a U-shape. Each locking lever 4 is also provided at the other end thereof with a knob attaching portion 45 on which a knob 46 is to be mounted. The spring plate portions 44 are an example of biasing means for resiliently biasing the locking levers 4 in the forward rotation direction so that the engagement pieces 43 are engaged with engagement portions 68 of a counter electrical connector to be discussed later. The knob attaching portions 45 and the knobs 46 are an example of the operating portions of the locking levers 4.

Figure 2:
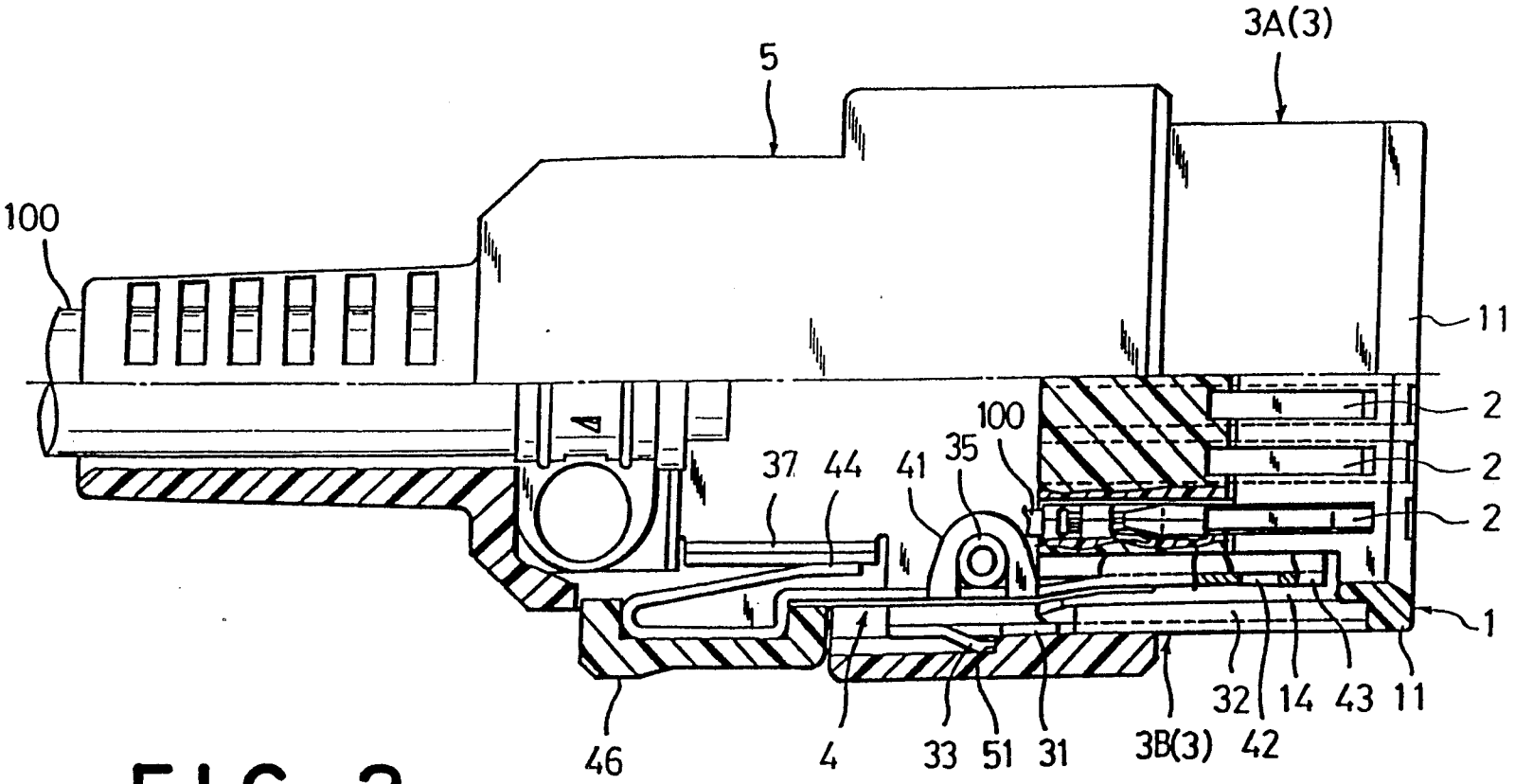
FIG. 2 is a plan view, with portions broken away, of the connector in FIG. 1.

The upper frame 3A and the lower frame 3B overlap each other. The engagement pawls 38 of the upper frame 3A are engaged with the engagement holes 36 of the lower frame 3B so that the frames 3A, 3B are connected to each other. The locking levers 4 are housed in both lateral ends of the space formed as surrounded by the upper and lower frames 3A, 3B thus connected. In such a state, pairs of upper and lower ring portions 41 of the locking levers 4 are fitted in and rotatably supported by the projections 35 of the upper and lower frames 3A, 3B. The overlapping engagement pieces 32 of the upper and lower frames 3A, 3B are inserted into the engagement grooves 14 in the main body 1, and the engagement pawls 34 are engaged with the engagement holes 15 in the main body 1, thereby preventing the main body 1 from coming out from the frames 3A, 3B. As shown in FIG. 2, a cap 5 previously put on a signal cable 100 is fitted to the upper frame 3A and the lower frame 3B. The outwardly turned engagement pawls 33 of the upper and lower frames 3A, 3B are engaged with stepped portions 51 of the cap 5, thereby preventing the frames 3A, 3B from coming out from the cap 5. The electric wires of the signal cable 100 are respectively connected to the contact pieces 2.

In the plug P thus assembled, the locking levers 4 are efficiently disposed in the lateral ends of the inside surrounded space formed by the shield frame unit 3. Further, this inside space may be assured without expanding the width of the plug P. Accordingly, neither the width nor the height of the plug P is increased. This advantageously prevents the plug P from being increased in size even though the locking levers 4 are disposed.

In the plug P, the tip portions of the spring plate portions 44 of the locking levers 4 are opposite to plate portions 37 of the upper and lower frames 3A, 3B, as shown in FIG. 2. Further, the entire periphery of the main body 1 housing the contact pieces 2 is surrounded by the upper frame 3A and the lower frame 3B. Thus, the shielding effect by the frame unit 3 extends over the main body 1 housing the contact pieces 2 and the entire exposed portion of the signal cable 100. Thus, the shield frame unit 3 produces an excellent shielding effect. Further, the upper frame 3A and the lower frame 3B are inserted, as overlapping each other, into the engagement grooves 14 in the main body 1. Further, the leg portions 31 are useful for enhancing the rigidity of the plug P, thus increasing the strength of the plug P in its entirety.

FIGS. 4 and 5 show a socket S to be used as the counter member of the plug P. The socket S has a socket body 6, contact pieces 7 and a shield frame unit 8.

The socket body 6 is made of a plastic molded body and has, in a unitary structure, a main body 61 and a contact piece holding member 62. The contact piece holding member 62 projects from the main body 61 substantially at the center portion thereof in the height direction. The main body 61 is provided at the lower portions of both lateral sides thereof with engagement projections 63, and at the center of the top surface thereof with an engagement projection 64. The main body 61 is also provided in the lower portion of the front side thereof with a narrow groove 65. Concaves **65*a* are formed in both lateral sides of the inner wall of the narrow groove 65, the concaves 65*a* being obliquely notched more deeply than the narrow groove 65. As shown in FIG. 5, the main body 61 has a plurality of grooves 66 which are opened in the back side and the underside of the main body 61. These grooves 66 respectively communicate with a plurality of slit-like openings 67 formed in the contact piece holding member 62. The contact piece holding member 62 is provided at both lateral sides of the tip thereof with projections 68 having inclined end surfaces 68*a***.

Each of the contact pieces 7 is made of an L-shaped metallic piece and has a terminal portion 71 and a horizontal piece portion 72. Each horizontal piece portion 72 is provided at the tip thereof with a small cut-raised engagement piece 73, and at the intermediate portion thereof with a cut-raised projection 74. The horizontal piece portions 72 are inserted into the main body 61 from the side of the grooves 66 and pass through the main body 61. Accordingly, the small engagement pieces 73 are inserted in and engaged with small holes 69 formed in the contact piece holding member 62, as shown in FIGS. 4 and 5. The projections 74 are engaged with the front end surface of the main body 61, thus preventing the contact pieces 7 from coming off from the main body 61. The terminal portions 71 of the contact pieces 7 are partly housed in the grooves 66 of the main body 61. The lower end portions of the terminal portions 71 project from the underside of the main body 61. Those parts of the terminal portions 71 which project downwardly from the underside of the main body 61, are adapted to be inserted into holes in a printed circuit board (not shown) and to be soldered thereto by a dipping method. The contact pieces 7 are held, in a vertically opposite manner, on and under the contact piece holding member 62. When assembling the contact pieces 7 with the main body 61, a plurality of contact pieces 7 are connected to one another by a tie bar, which is adapted to be separated from the contact pieces 7 after the contact pieces 7 are assembled.

A shield frame unit 8 comprises a first frame 8A and a second frame 8B.

The first frame 8A is made in the form of a casing by applying predetermined operations such as bending or the like to a single large metallic plate having relatively great rigidity. The first frame 8A has a bottom wall 81, a rear end portion of which is provided at both lateral sides thereof with projecting pieces 82. The first frame 8A is provided in the center of the upper wall 83 thereof with an engagement hole 84. The upper wall 83 is provided at both lateral sides thereof with pawls 85 which are cut and obliquely inwardly raised. The upper wall 83 is also provided in both transverse corners thereof with engagement holes 86. Openings 88 are formed in the lateral walls 87 of the first frame 8A.

The second frame 8B is formed by applying predetermined operations such as bending or the like to a single metallic plate. The second frame 8B has a rear plate portion 91 which is provided at both lateral ends thereof with forwardly projecting arms 92. The arms 92 are provided at the free ends thereof with inwardly projecting contacts 93. The arms 92 have, in a unitary structure, outwardly turned engagement pawls **94*a*, inwardly turned engagement pawls and downwardly projecting terminals 95. The rear plate portion 91 is turned to form a forwardly projecting upper plate portion 96. The upper plate portion 96 has upwardly projecting members 97**.

The second frame 8B is fitted, from the rear portion of the connector body 6, into the connector body 6 incorporating a predetermined number of contact pieces 7. The inwardly turned engagement pawls of the second frame 8B are engaged with the engagement projections 63 of the connector body 6 from the front side thereof. The arms 92 of the second frame 8B are opposite to the lateral sides of the contact piece holding member 62 of the connector body 6 with distances provided between the arms 92 and the lateral sides of the contact piece holding member 62. The first frame 8A is fitted to the connector body 6 and the arms 92 of the second frame 8B assembled with the connector body 6, from the front side thereof. As shown in FIG. 5, the pawls 85 of the first frame 8A come in contact and are engaged with the upper portion of the front end surface of the main body 61. As shown in FIG. 4, the engagement projection 64 of the main body 61 is engaged with the engagement hole 84 in the first frame 8A. Accordingly, the first frame 8A is secured to the connector body 6 and the engagement holes 86 in the first frame 8A are engaged with the outwardly turned engagement pawls 94*a* of the second frame 8B, so that both the frames 8A, 8B are secured to each other. As shown in FIG. 5, the projecting members 97 of the second frame 8B resiliently come in contact under pressure with the inner surface of the upper wall 83 of the first frame 8A, so that both the frames 8A, 8B are electrically connected securely to each other. The contacts 93 of the arms 92 face the openings 88. The rear end of the bottom wall 81 of the first frame 8A is fitted in the narrow groove 65 in the main body 61. The projecting pieces 82 are fitted in the concaves 65*a*.

In the socket S assembled in the manner mentioned above, the main body 61 and the contact piece holding member 62 are surrounded by the first frame 8A, and the rear surface of the main body 61 is covered with the rear plate portion 91 of the second frame 8B. Accordingly, the shielding effect by the first frame 8A and the second frame 8B is extended on the connector body 6 and the contact pieces 7 substantially in their entireties. Thus, the first frame 8A and second frame 8B produce an excellent shielding effect.

The socket S described in the foregoing is adapted to be mounted on a printed circuit board (not shown) with the bottom wall 81 of the first frame 8A being opposite to the printed circuit board, and adapted to be soldered to the printed circuit board by a dipping method. In this connection, the terminal portions 71 of the contact pieces 7 and the terminals 95 of the second frame 8B project downwardly. In such a socket S, i.e., the socket S of the right-angle type which is adapted to be mounted on a printed circuit board with the bottom wall 81 of the first frame 8A being opposite to the printed circuit board, it is required to prevent a flux from entering inside of the connector body 6 at the time when the socket S is soldered. In this connection, stand portions may be formed, as spacers, at the main body 61, thereby separating the main body 61 from the printed circuit board. When using the surface-mounting method with the socket S of the right-angle type, the terminal portions 71 of the contact pieces 7 may be turned (as shown by virtual lines in FIG. 5) and extended, substantially at the same level as that of the bottom surface of the main body 61, toward the rear side of the main body 61.

Figure 3:
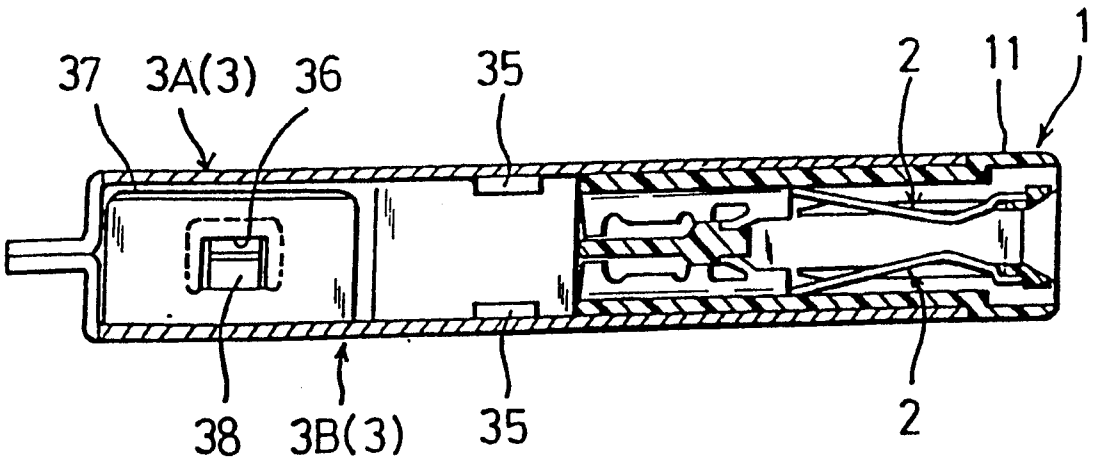
FIG. 3 is a vertical section view of the connector in FIG. 1.
Figure 6:
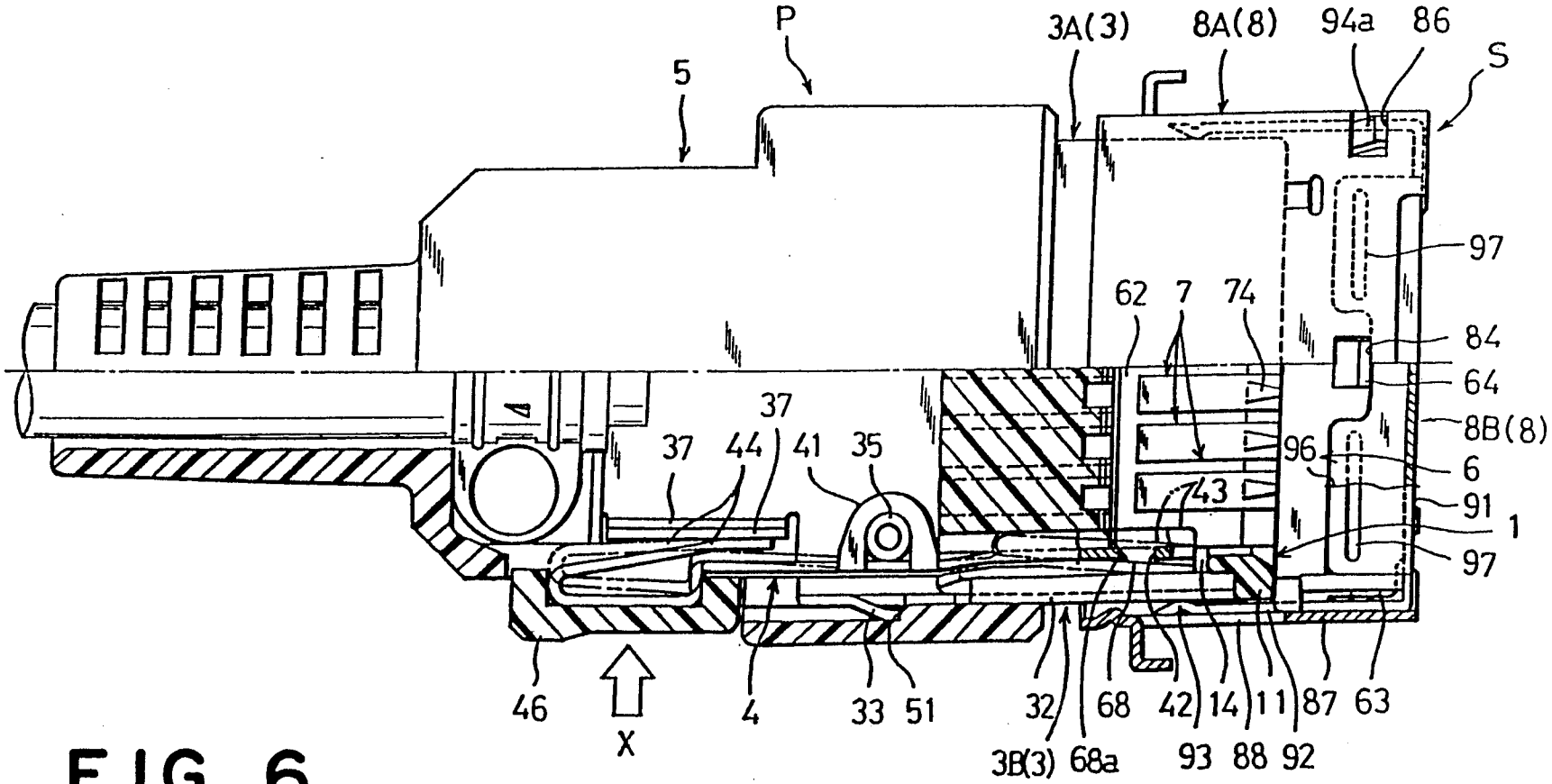
FIG. 6 is a plan view, with portions broken away, of the electrical connector in accordance with the present invention as connected to the counter electrical connector.

FIG. 6 shows the plug P discussed in connection with FIGS. 1 to 3 as connected to the socket S discussed in connection with FIGS. 4 and 5.

When the plug P is inserted into the socket S, the tips of the engagement pieces 43 of the locking levers 4 are pushed and directed outside with respect to the projections 35 by the inclined end surfaces 68*a* of the projections 68 in the socket S. At this time, the spring plate portions 44 strike against the plate portions 37 of the shield frame unit 3, causing the spring plate portions 44 to be deformed against the resiliency thereof. When the tips of the engagement pieces 43 get over the engagement portions 68, the spring loads of the spring plate portions 44 cause the engagement pieces 43 to be forwardly rotated and inwardly displaced so that the locking holes 42 are fitted to the engagement portions 68. Accordingly, the engagement portions 68 are engaged with the locking holes 42 so that the plug P is locked with the socket S.

For removing the plug P from the socket S, the knobs 46 are pushed in a direction shown by an arrow X in FIG. 6. Then, as shown by the virtual lines in FIG. 6, the spring plate portions 44 are pushed to the plate portions 37, causing the spring plate portions 44 to be deformed. At the same time, the engagement pieces 43 are turned outside with respect to the projections 35. This causes the engagement portions 68 to come out from the locking holes 42, thus releasing the locked state. The knobs 46 are disposed at such positions that the plug P is adapted to be grasped with the hand when removing the plug P. Accordingly, a force in the direction shown by the arrow X is naturally applied to the knobs 46 by the plug removing force. This is very convenient in use.

There are instances where, when the plug P is removed from the socket S, the plug P is forcibly pulled out with a strong force without the locked state released. In this case, the engagement portions 68 are always sheared to cause the plug P to be pulled out since the locking levers 4 are made of metal and the engagement portions 68 are molded bodies of plastic which is apt to be sheared more easily than metal. However, even though the engagement portions 68 are sheared, this exerts no influence upon the original function, i.e., signal transmission/reception function, and the shielding function of the plug P and the socket S. Accordingly, the continuous use of the plug P as sheared is allowed with no inconveniences.

When the plug P is inserted into the socket S, both the frame units 3, 8 come in contact with each other so that the connected portions of the plug P and the socket S are entirely surrounded by the frame units 3, 8. Thus, the frame units 3, 8 produce an excellent shielding effect. Particularly, the contacts 93 at the free ends of the arms 92 of the second frame 8B in the socket S, come in contact with the outside surfaces of the lateral walls of the shield frame unit 3 of the plug P. Accordingly, even though the second frame 8B is made of metal having no great resiliency, the contacts 93 may be apt to be readily displaced by the resilient deformation of the arms 92. When inserting the plug P, the arms 92 are pushingly expanded by the shield frame unit 3 of the plug P, causing the arms 92 to be displaced without force. This assures a smooth insertion of the plug. When the plug P is pulled out, the resiliency of the arms 92 causes the contacts 93 to be returned to the original positions, so that the socket S is prepared for the next insertion of the plug P. Accordingly, even though the plug P is repeatedly inserted in and removed from the socket S, the contacts 93 resiliently come in contact, under suitable contact pressure, with the shield frame unit 3 of the plug P. In addition, the contacts 93 are locally strongly contacted under pressure with the shield frame unit 3, so that the shield frame units 3, 8 are electrically securely connected to each other. Thus, an excellent shielding effect is produced on the connected portions of the socket S and the plug P with the smooth insertion and removal of the plug P not sacrificed. Further, even though the plug P is twisted when the plug P is inserted or removed, the arms 92 follow such a twist and are resiliently deformed without force. This prevents the arms 92 from being deformed to such an extent as not to be restored.

What is claimed is:

1. An electrical connector, comprising:

a main body which houses and holds a plurality of contact pieces in parallel with one another, said main body having a rear portion and lateral sides, both lateral sides being provided with longitudinally extending engagement grooves;

a shield frame unit surrounding the rear portion of said main body, said shield frame unit being divided into an upper frame and a lower frame, each with a left- and right-hand leg portion and with the end edges of each of the left- and right-hand leg portions being provided with inwardly turned engagement pieces which are inserted into respective engagement grooves of said main body when the upper frame and lower frame overlap each other, said upper frame and lower frame forming an inside space when they overlap, in which projections formed on said upper frame and lower frame are located;

locking levers housed in said inside space at lateral sides of said shield frame unit arranged in the parallel direction of said contact pieces, said locking levers being rotatably supported by said projections, said locking levers having operating portions formed at one end and engagement pieces formed at their other end, said engagement pieces being adapted to be engaged with an disengaged from engagement portions formed at a counter electrical connector when said locking levers are forwardly and reversely rotated around said projections; and biasing means disposed between said locking levers and said shield frame unit and adapted to resiliently bias said locking levers in the forward rotation direction where said engagement pieces of said locking levers are engaged with said engagement portions;

wherein said operating portions are adapted to displace said locking levers in the reverse rotation direction where said engagement pieces of said locking levers are disengaged from said engagement portions against the resilient biasing forces of said biasing means.

2. An electrical connector according to claim 1, wherein the engagement portions of the counter electrical connector are made of synthetic resin, and the engagement pieces of the locking levers are made of metal.

3. An electrical connector according to claim 1, wherein the operating portions are located in positions at which said electrical connector is adapted to be grasped when pulling out said electrical connector.

4. An electrical connector according to claim 1, wherein said biasing means comprise: spring plate portions bent in a U-shape and formed at said one end of said locking levers; and plate portions formed at the shield frame unit which face tip portions of said spring plate portions.

5. An electrical connector according to claim 4, wherein the operating portions are located in positions at which said electrical connector is adapted to be grasped when pulling out said electrical connector.

* * * * *